US007112128B1

(12) United States Patent
Kirschhoffer et al.

(10) Patent No.: US 7,112,128 B1
(45) Date of Patent: Sep. 26, 2006

(54) SANDING TOOL WITH PROTECTIVE CLAMPING MECHANISM

(75) Inventors: Jon A. Kirschhoffer, White Bear Lake, MN (US); Eric R. Cybulski, Woodbury, MN (US); Ryan Patrick Simmers, Cottage Grove, MN (US); Bernard A. Gonzalez, St. Paul, MN (US); Erik J. Johnson, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 36 days.

(21) Appl. No.: 11/201,743

(22) Filed: Aug. 11, 2005

Related U.S. Application Data

(63) Continuation-in-part of application No. 11/117,932, filed on Apr. 29, 2005.

(51) Int. Cl.
*B24B 45/00* (2006.01)

(52) U.S. Cl. ..... 451/499; 451/525

(58) Field of Classification Search ..... 451/495, 451/490, 514–524, 499, 458
See application file for complete search history.

(56) References Cited

U.S. PATENT DOCUMENTS

| | | | | |
|---|---|---|---|---|
| 5,168,672 | A | 12/1992 | Grëgoire, Sr. | |
| 5,588,904 | A * | 12/1996 | Allport | 451/512 |
| 5,863,243 | A * | 1/1999 | Ali | 451/503 |
| 5,902,176 | A * | 5/1999 | Chen | 451/524 |
| 6,613,113 | B1 | 9/2003 | Minick et al. | |
| 6,755,727 | B1 * | 6/2004 | Bjerkhoel | 451/513 |
| 6,887,143 | B1 * | 5/2005 | Bocka et al. | 451/359 |
| 6,935,936 | B1 * | 8/2005 | Goulet et al. | 451/344 |
| 2003/0104777 | A1 | 6/2003 | Deshler | |

* cited by examiner

*Primary Examiner*—Dung Van Nguyen
(74) *Attorney, Agent, or Firm*—David B. Patchett

(57) ABSTRACT

A hand-held, manually-operated sanding tool for use with a replaceable sheet-like abrasive material, such as sandpaper, includes a base member and one or more clamping mechanisms pivotally connected with opposed ends of the base member. The clamping mechanism(s) include a tensioning member arranged to slidably interface with a corresponding contact surface provided at the end of the base member to tighten the sheet-like abrasive material as it is installed on the tool. Further, the tensioning member positions a leading edge thereof so as to minimize possible harmful contact with a user's finger(s) during loading of the abrasive material.

18 Claims, 5 Drawing Sheets

SANDING TOOL WITH PROTECTIVE CLAMPING MECHANISM

CROSS-REFERENCE TO RELATED APPLICATIONS

This application is a continuation-in-part of U.S. application Ser. No. 11/117,932, filed Apr. 29, 2005, and entitled "Sanding Tool".

BACKGROUND

The present invention relates generally to hand-held, manually-operated sanding tools that use a sheet of abrasive material such as sandpaper.

Abrasive sheets, such as conventional sandpaper, are commonly used to hand sand or finish a work surface, such as a wooden surface. In hand sanding, the user holds the sandpaper directly in his or her hand to move the sandpaper across the work surface. Sanding by hand can, or course, be an arduous task. To facilitate the hand sanding process, the sandpaper may be placed on a sanding block. Sanding blocks hold the sandpaper and can be readily grasped by a user to make hand sanding faster and easier. A commercially available sanding block is the 3M™ Rubber Sanding Block available from 3M Company, St. Paul, Minn.

Sanding blocks are known in the patented prior art. U.S. Pat. No. 5,168,672, for example, discloses an abrasive sheet holder having a base provided with clamping shoulders formed in a pair of opposed side edges thereof. A handle member is detachably secured over a rear surface of the base. The handle member has opposed flexible flange walls for clamping opposed end edge portions of an abrasive paper sheet which is positioned over a front working surface of the base with the edge portions of the paper sheet extending over the clamping shoulders.

U.S. Patent Application Publication No. 2003/0104777 discloses a sanding block including a generally rectangular base housing upon which a multi-contoured, generally convex hand grip is secured. The hand grip further defines inwardly extending concave portions that facilitate easy and secure grip by the user. An over-center lever clamp mechanism is operative at each end of the sanding block to secure the opposed ends of a sandpaper sheet in a releasable attachment.

Known sanding blocks suffer from one or more drawbacks or shortcomings. For example, tensioning the abrasive media is a desirable feature of sanding blocks. With known sanding blocks, however, it is often difficult to load the abrasive media and get it tight. If the media is not tight, it may wrinkle, and the wrinkles may snag on the work surface and cause the abrasive media to tear. In addition, wrinkles in the abrasive media may cause the work surface to be damaged or sanded unevenly.

Known sanding blocks may also require both ends of the abrasive sheet to be installed in the sanding block simultaneously, which can require considerable dexterity. Known sanding blocks also tend to be difficult and/or expensive to manufacture. Other sanding blocks may damage the abrasive sheet as it is installed on the tool, or may not optimally utilize the full sanding area of the abrasive sheet. There is, therefore, a need for a sanding block that is easy and inexpensive to manufacture, that can tension the abrasive sheet, that securely holds the abrasive sheet, is comfortable to use, and allows worn abrasive sheets to be quickly and easily replaced, and minimizes opportunity for user injury.

It would be desirable to provide a hand-held, manually-operated, sanding tool that securely holds, and is capable of tensioning, flexible flat sheets of abrasive material, such as conventional sandpaper, as well as resilient flexible abrasive sheets that are thicker than conventional sandpaper, such as the sheet-like abrasive materials described in, for example, U.S. Pat. No. 6,613,113 (Minick et al.). In addition, it would be desirable to provide such a sanding tool that can be manufactured easily and cost effectively, is comfortable to use, allows worn sheets to be quickly and easily replaced, and allows sheet-like abrasive materials to be secured tightly to the sanding tool without unnecessary slack and without damaging the abrasive sheet.

SUMMARY

The invention overcomes the above-identified limitations in the field by providing a sanding tool that not only securely holds the abrasive media but minimizes the opportunity for user injury when loading the abrasive media to the tool. The tool is able to accommodate different types, widths, and thicknesses of sheet-like abrasive media. In addition, the tool is simple to operate, requiring no special tools, and is designed to be easy to manufacture and assemble.

Aspects of the present invention relate to a hand-held, manually-operated sanding tool for use with a replaceable sheet-like abrasive material. The sanding tool includes a base member and a clamping mechanism. The base member defines first and second opposing ends, a bottom surface, and at least one upper contact surface opposite the bottom surface and adjacent one of the first and second ends. The clamping mechanism includes a pivoting member and a tensioning member. The pivoting member has a mounting section and a front section. The mounting section is pivotally connected to the base adjacent the upper contact surface, with the front section being opposite the mounting section. The tensioning member includes a gripping wall extending from the front section of the base and terminating at a leading edge. To this end, the gripping wall forms a first bend adjacent the leading edge, such that the gripping wall extends inwardly relative to the front section of the pivoting member from the first bend to the leading edge. With this in mind, the clamping mechanism is movable relative to the base between an open position and a closed position. In the open position, the pivoting member locates the gripping wall away from the upper contact surface to define a gap for receiving a sheet of abrasive material. In the closed position, the front section of the pivoting member is more proximate the upper contact surface such that the sheet of abrasive material is tensioned between the gripping wall and the upper contact surface as the clamping mechanism transitions from the open position to the closed position. This, in turn, tightens a fit of the abrasive sheet against the bottom surface of the base member.

In certain aspects of the invention, the gripping wall forms a plurality of spaced lateral bends including the first bend such that the gripping wall assumes as step-like shape in transverse cross-section. In other aspects of the present invention, the first bend defines a bend angle of at least 210° so as to minimize the opportunity for possible contact with the leading edge by a user's finger(s) otherwise inserted between the clamping mechanism and the upper contact surface of the base member.

Other aspects of the present invention relate to a hand-held, manually-operated sanding tool for use with a replaceable sheet-like abrasive material. The sanding tool includes a base member and a clamping mechanism. The base member defines first and second opposing ends, a bottom surface, and at least one upper contact surface opposite the bottom surface and adjacent one of the first and second ends. The clamping mechanism includes a pivoting member and a tensioning member. The pivoting member includes a mounting section pivotally connected to the base member adjacent the upper contact surface, as well as a front section opposing the mounting section. With this construction, the pivoting member can rotate relative to the base member between a closed position and an open position. In the closed position, the front section is proximate the upper contact surface of the base member. In the open position, an increased spaced is established between the front section and the upper contact surface. Further, assembly of the base member and the pivoting member such that rotation of the pivoting member is relative to the base member beyond a maximum open position is limited. The tensioning member includes a gripping wall defining trailing, intermediate, and leading regions. The trailing region extends from the front section of the pivoting member. The intermediate region extends from the trailing region. The leading region extends from the intermediate region and terminates in a leading edge opposite the intermediate region. With this in mind, the clamping mechanism is configured such that in the maximum open position, the leading region orients the leading edge inwardly away from the intermediate region to minimize contact between the leading edge and a user's finger otherwise inserted between the gripping wall and the upper contact surface. Further, the clamping mechanism serves to contact and tension a sheet of abrasive material placed between the gripping wall and the contact surface upon transitioning of the pivoting member from the opened position to the closed position. With this construction, the opportunity for a user to accidentally cut his or her finger, via direct contact with the leading edge, while loading the sanding tool with the sheet of abrasive material is greatly minimized.

BRIEF DESCRIPTION OF THE DRAWINGS

The present invention will be further described with reference to the accompanying drawings, in which.

DETAILED DESCRIPTION

Figure 1:
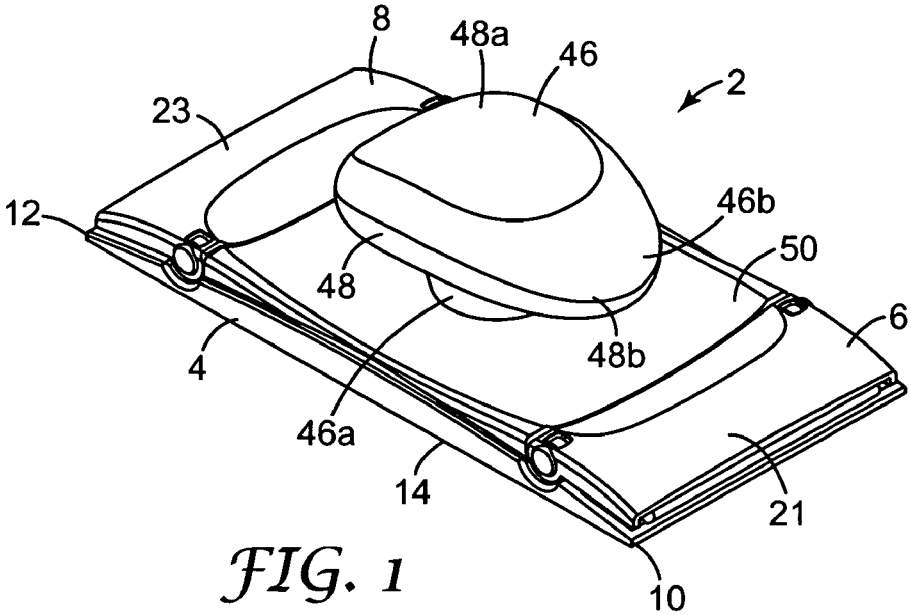
FIG. 1 is a perspective view of a hand-held, manually-operated sanding tool according to principles of the present invention.
Figure 2:
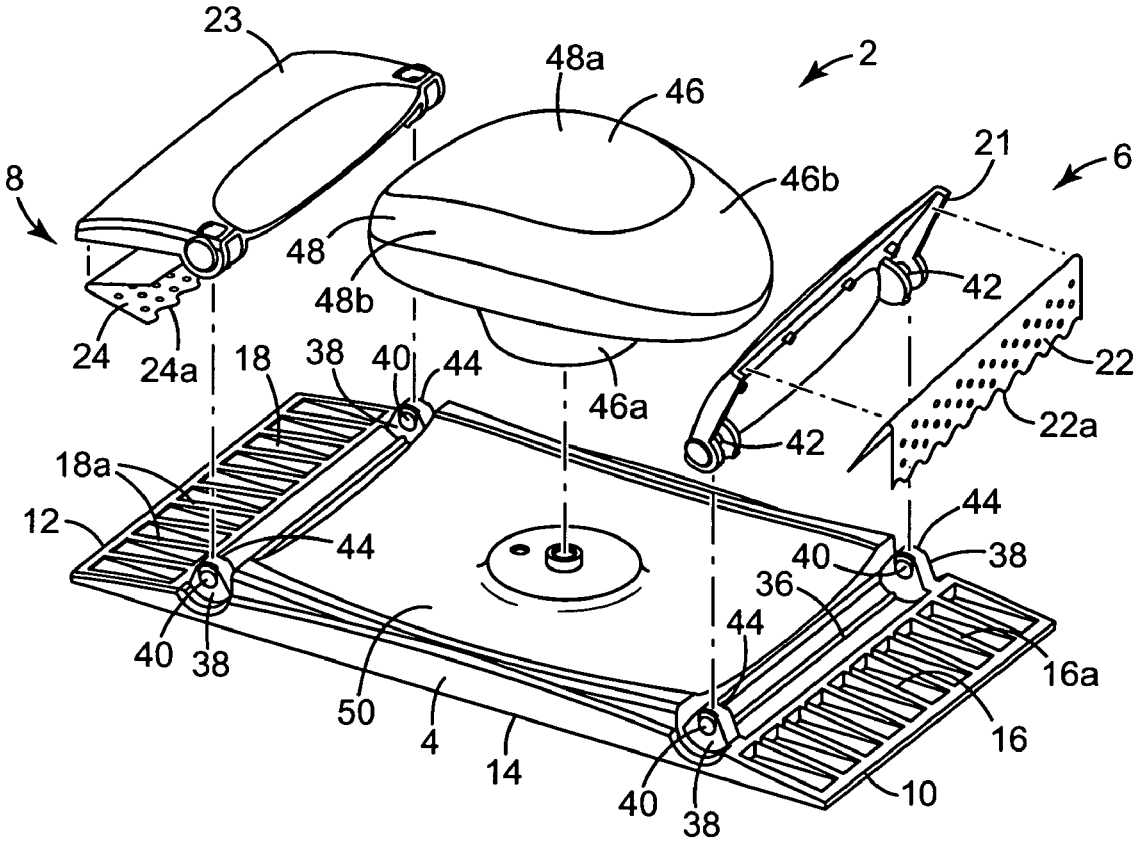
FIG. 2 is an exploded view of the sanding tool of FIG. 1.
Figure 3:
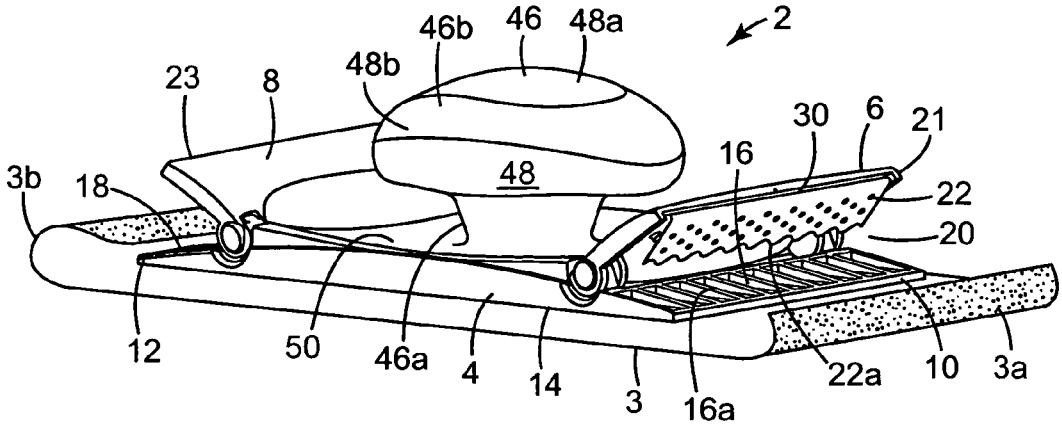
FIG. 3 is a perspective view of the sanding tool of FIG. 1 with the clamping mechanisms shown in their open positions.
Figure 4:
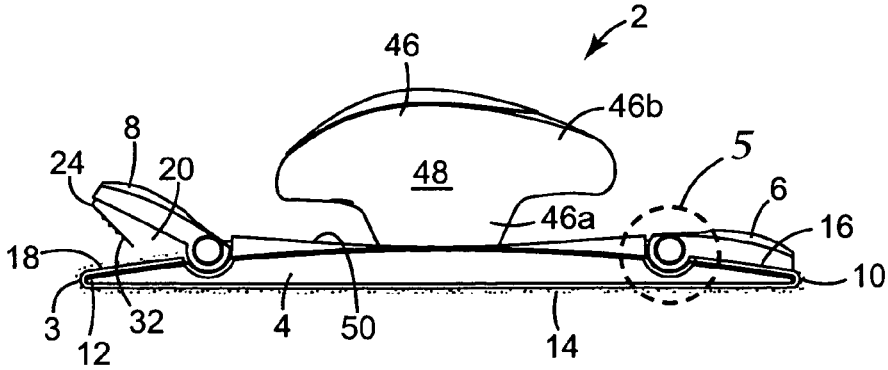
FIG. 4 is a side view of the sanding tool of FIG. 1 shown with a sheet of abrasive material installed on one end.

Referring now to the drawings, wherein like reference numerals refer to like or corresponding parts throughout the several views, FIGS. 1–5, show one embodiment of a hand-held, manually-operated sanding tool or sanding block 2 for use with a flexible, replaceable, sheet-like abrasive material 3 (FIGS. 3 and 4). The term "manually-operated" refers to the fact that the tool 2 is not a power tool. That is, all of the power for the tool is provided by the user and the tool itself does not include a motor. It will be recognized, however, that the present invention may be a power tool and is not limited to manually-operated tools.

The sanding tool 2 includes a base member 4 and a pair of clamping mechanisms 6, 8 connected with opposed ends of the base member 4. Although the sanding tool 2 is shown with clamping mechanisms 6, 8 at both ends, it will be recognized that one of the clamping mechanisms 6, 8 may be replaced with a conventional mechanism for securing the abrasive sheet-like material 3 to the tool. It will also be recognized that although the base member 4 is shown as being rectangular, it may also be square or other shapes that lend themselves for use with conventional abrasive sheets.

The base member 4 has first 10 and second 12 opposed ends and a generally planar bottom surface 14 against which the sheet-like abrasive material 3 is secured. As used through the specification, the terms "sheet-like abrasive material" and "sheet of abrasive material" refer to thin, flexible, generally square or rectangular sheets of abrasive material having discrete ends that can be attached to a sanding block. Such sheet-like abrasive material include, for example, conventional sandpaper, flexible sanding scrims, non-woven abrasive materials such as Scotch-brite™ available from 3M Company, St. Paul, Minn., and thin flexible abrasive sheet materials such as those described in U.S. Pat. No. 6,613,113 (Minick et al.), the entire contents of which are hereby incorporated by reference. The tool may also find use with non-abrasive sheet-like materials such as dust removing tack cloths. The term sheet-like abrasive material, however, does not include so called endless belts of abrasive material commonly used on power sanding tools, die cut sheets that are sold pre-cut to match the size and shape of a particular sanding tool as is commonly done for power detail sanding tools, or abrasive sheets having their own attachment means, such as adhesive or hook and loop type fasteners, that allow such abrasive articles to be attached to a tool.

Each end 10, 12 of the base member 4 has an inclined or angled contact surface 16, 18, respectively, opposite the bottom surface 14. In this manner, the contact surfaces 16, 18 and bottom surface 14 form an acute angle relative to the associated adjacent end 10, 12, respectively. In the illustrated embodiment, the contact surfaces 16, 18 are defined by the exposed upper surfaces of a plurality of spaced ribs 16*a*, 18*a*. By providing spaced ribs 16*a*, 18*a*, the contact surface area between the sheet of abrasive material 3 and the associated contact surface 16, 18 is decreased (as compared to a continuous surface), thereby allowing the sheet 3 to slide upwardly along the contact surface 16, 18 more readily to tension the sheet of abrasive material 3. In addition, the inclined contact surfaces 16, 18 may optionally include an abutment surface or stop (not shown) to control how far a user can insert an end of the abrasive sheet 3 into an end of the tool. Alternatively, the tool 2 can include visual indicating means identifying how far the end of the sheet of abrasive material 3 should be inserted into the tool 2 during installation. This ensures that as the user is inserting the first end of the abrasive material 3 into the tool 2, a sufficient amount of the abrasive material 3 will be left remaining for insertion into the other end of the tool.

Each clamping mechanism 6, 8 is pivotally connected with opposite ends 10, 12 of the base member 4 adjacent the contact surface 16, 18, respectively, thereby defining a jaw into which the ends 3*a*, 3*b* (FIG. 3) of the sheet-like abrasive material 3 may be inserted. Each clamping mechanism 6, 8 is movable between an open position (shown in FIG. 3) and a closed position (shown in FIG. 1). In the open position, the clamping mechanisms 6, 8 are spaced from the associated contact surface 16, 18, thereby defining a gap 20 between the base member 4 contact surface 16, 18 and the clamping mechanism 6, 8. The gap 20 is sized to receive the ends 3*a*, 3*b* of the sheet-like abrasive material 3 which typically have a thickness of less than about 10 millimeters (mm), more typically, about 0.1 mm to about 8 mm, and even more typically about 0.5 mm to about 5 mm. In the closed position, the clamping mechanisms 6, 8 are moved toward the associated contact surfaces 16, 18, respectively, and, when no abrasive material is present, are arranged adjacent to the contact surfaces 16, 18, respectively.

Each clamping mechanism 6, 8 includes a pivoting member 21, 23 pivotally connected with the base member 4 and a flexible tensioning member 22, 24 arranged on the under side of the pivoting member 21, 23 so that it faces the associated contact surface 16, 18. Arranged in this manner, as the clamping mechanisms 6, 8 are lowered toward the base member 4 to secure the abrasive material 3 to the tool 2, the terminal edges of the tensioning members 22, 24 slidably engage the contact surfaces 16, 18. Thus, when an end 3*a*, 3*b* of an abrasive sheet 3 is inserted in the gap 20 between the base member 4 and a clamping mechanism 6, 8, and the clamping mechanism 6, 8 is moved from its open position to the closed position, the edge of the tensioning members 22, 24 will frictionally engage the end 3*a*, 3*b* of the sheet of abrasive material 3.

As the clamping mechanisms 6, 8 are further urged toward the contact surfaces 16, 18, the tensioning members 22, 24 grip the ends 3*a*, 3*b* of the abrasive sheet 3 and move it upwardly along the inclined contact surfaces 16, 18 away from the associated end 10, 12, thereby drawing the sheet of abrasive material 3 farther into the gap 20. In addition, as the clamping mechanisms 6, 8 are urged against the contact surfaces 16, 18, the tensioning members 22, 24 tend to bow or flex such that the bowed surface of the tensioning members 22, 24 will engage the contact surfaces 16, 18, thereby increasing the overall contact surface area between the tensioning members 22, 24 and the sheet of abrasive material 3. In this manner, slack in the abrasive sheet 3 is taken up, thereby tightening the fit of the abrasive sheet 3 against the bottom 14 of the base member 4.

In the illustrated embodiment, the tensioning members 22, 24 are thin flexible strips of metal, such as a leaf spring, that generally return to their original positions when the applied force is released. Other materials such as a stiff resilient rubber or synthetic plastic material may also be used. To distribute the force applied by the tensioning members 22, 24 to the ends abrasive sheet 3*a*, 3*b* evenly (both during the installation of the abrasive sheet 3 onto the tool and while the abrasive sheet is being held onto the tool), the tensioning members 22, 24 preferably extend continuously across substantially the entire width of the clamping mechanisms 6, 8. By distributing the force in this manner, the tensioning members 22, 24 have a reduced tendency to tear or otherwise damage the abrasive sheet material 3.

To further reduce the likelihood that the ends of the tensioning members 22, 24 will dig into the abrasive sheet 3, and thereby possibly damage the abrasive sheet 3, in an alternative embodiment, the tensioning members 22, 24 may be curved or bowed inwardly such that the tensioning members 22, 24 have curved surfaces that face the contact surfaces 16, 18, and engage the contact surfaces when the clamping mechanisms 22, 24 are closed.

To improve the holding and retaining capability of the tensioning members 22, 24, each tensioning member 22, 24 may include an optional wavy terminal edge 22*a*, 24*a*. Other shapes for the terminal edge are contemplated in connection with the present invention. For example, the terminal edge could be serrated, notched, or ridged. In addition, the tensioning members 22, 24 may be formed with separate flexible fingers that can individually flex to better accommodate rough or contoured surfaces. The flexible fingers may also include a shaped terminal edge.

To increase the coefficient of friction between the tensioning members 22, 24 and the abrasive sheet 3, and thereby improve the ability of the tensioning members 22, 24 to firmly grip and retain the abrasive sheet 3 (and therefore securely hold the abrasive sheet 3 both as the abrasive sheet 3 is installed on the tool and during use after the abrasive sheet is installed on the tool 2), the tensioning members 22, 24 may optionally include a gripping surface 30, 32. In the illustrated embodiment, the gripping surface 30, 32 comprises a plurality of projections. Alternatively, the gripping surface 30, 32 may comprise, for example, a smooth pliable surface formed of, for example, rubber.

Figure 5:
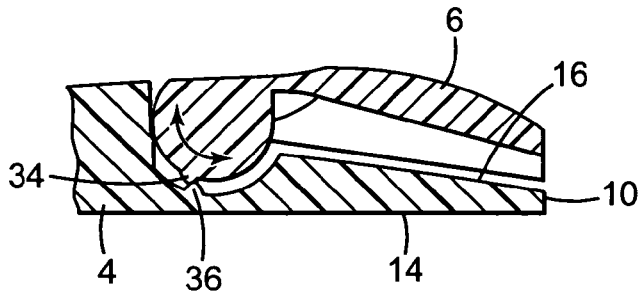
FIG. 5 is a detailed sectional view showing the locking means between the base member and the clamping mechanism.

As shown in detail in FIG. 5 with respect to clamping mechanism 6, the tool 2 includes, in one embodiment, locking means comprising cooperating projections 34, 36. More particularly, the clamping mechanism 6 includes a moving locking projection 34 and the base member 4 includes a cooperating fixed stop projection 36. The cooperating projections 34, 36 are arranged in abutting relation to provide locking means to maintain the clamping mechanism 6 in either its opened or closed position. Thus, when the clamping mechanism 6 is arranged in its open position (i.e., spaced from its associated contact surface 16), the projection 34 is positioned below—in a counterclockwise direction from—the cooperating base member projection 36. As the clamping mechanism 6 is rotated downwardly toward the associated contact surface 16 to its closed position, the projection 34 rotates and abuts the cooperating base member projection 36, which is a fixed portion of the base member 4.

As the clamping mechanism 6 is further urged downwardly toward the associated contact surface 16, the clamping mechanism 6 projection 34 is forced past the base member projection 36 until the clamping mechanism 6 projection 34 is positioned above—in a clockwise direction from—the base member projection 36. As this occurs, the clamping mechanism 6 snaps from its open position to its closed position adjacent the contact surface 16. Once in the closed position, the projections 34, 36 tend to maintain the clamping mechanism 6 in the closed position until the clamping mechanism 6 is forced upwardly to its open position and the clamping mechanism projection 34 is once again positioned below—in a counterclockwise direction from—the base member projection 36.

The projections 34, 36 allow the clamping mechanisms 6, 8 to be repeatedly opened and securely closed—quickly and easily—each time a worn sheet of abrasive material is removed from the tool 2 and replaced with a new sheet. In addition, by providing the tool 2 with independently actuated clamping mechanisms 6, 8, the ends 3*a*, 3*b* of the sheet of abrasive material 3 can be loaded into the tool 2 separately, one end at a time. That is, in contrast to some currently available sanding blocks, a user is not required to insert both ends of the abrasive sheet into the tool simultaneously, and then clamp the ends of the abrasive sheet in the tool simultaneously. Alternatively, the locking means can assume a variety of other configurations that effectuate locking of the clamping mechanism 6 relative to the base member in one or both of the open position(s) and/or the closed position. Even further, the locking means is not a required feature such that in alternative embodiments, the projections 34, 36 are eliminated entirely.

Referring to FIG. 2, to provide the pivotal connection between the base member 4 and the clamping mechanisms 6, 8, the base member 4 includes raised attachment members 38 containing through-bores 40 that rotatably receive protuberances 42 that are provided on the retaining members 6, 8. The protuberances 42 are sized to snap fit into the through-bores 40 to allow for quick and easy assembly of the tool 2. To provide a generally permanent attachment of the retaining members 6, 8 to the base member 4, the attachment members 38 contain angled slots 44 that allow the protuberances 42 to be easily pushed into the slot 44 and into mating relation with the through-bores 40, but make it difficult for the protuberances 42 to be removed or disengaged from the through-bores 40. It will be recognized that other snap fit connections may be used to attach the retaining members 6, 8 to the base member 4. For example, the raised support members may have aligned channels, and the retaining members may include a shaft configured to snap-fit in rotatable mating relation with the aligned channels. In addition, the tool may have a unitary one-piece construction in which the pivotal connection between the base member 4 and the retaining members 6, 8 is provided by a living hinge.

The tool 2 also includes a handle 46. In the illustrated embodiment, the handle 46 includes a neck portion 46*a* that extends upwardly from a central region of the base member 4, and includes an enlarged head portion 46*b* located at the end of the neck 46*a* that defines a knob 48 that can be readily grasped by a user to maneuver and control the movement of the tool 2. To provide the user with a more comfortable grip, the knob 48 portion of the handle 46 preferably comprises an interior region 48*a* formed of a relatively hard first material and a peripheral region 48*b* formed of a relatively soft rubber-like second material that is easier to grip and thereby provides the user with improved handling. The first relatively hard material, may be, for example, a hard synthetic plastic, and the relatively soft second material may be, for example, a thermoplastic elastomer, rubber, rubber-like materials, or foam.

To create a tool 2 having a low profile that is easy to maneuver and less likely to tip during use, the base member 4 has a recessed top surface 50. The recessed surface 50 provides additional space in the region above the base member 4 and below the knob 48 for a user's fingers.

The tool 2, including the base member 4, clamping mechanisms 6,8 and handle 46, may be formed of any suitable material including, for example, wood, metal, synthetic plastic, or a stiff rubber.

Figure 6:
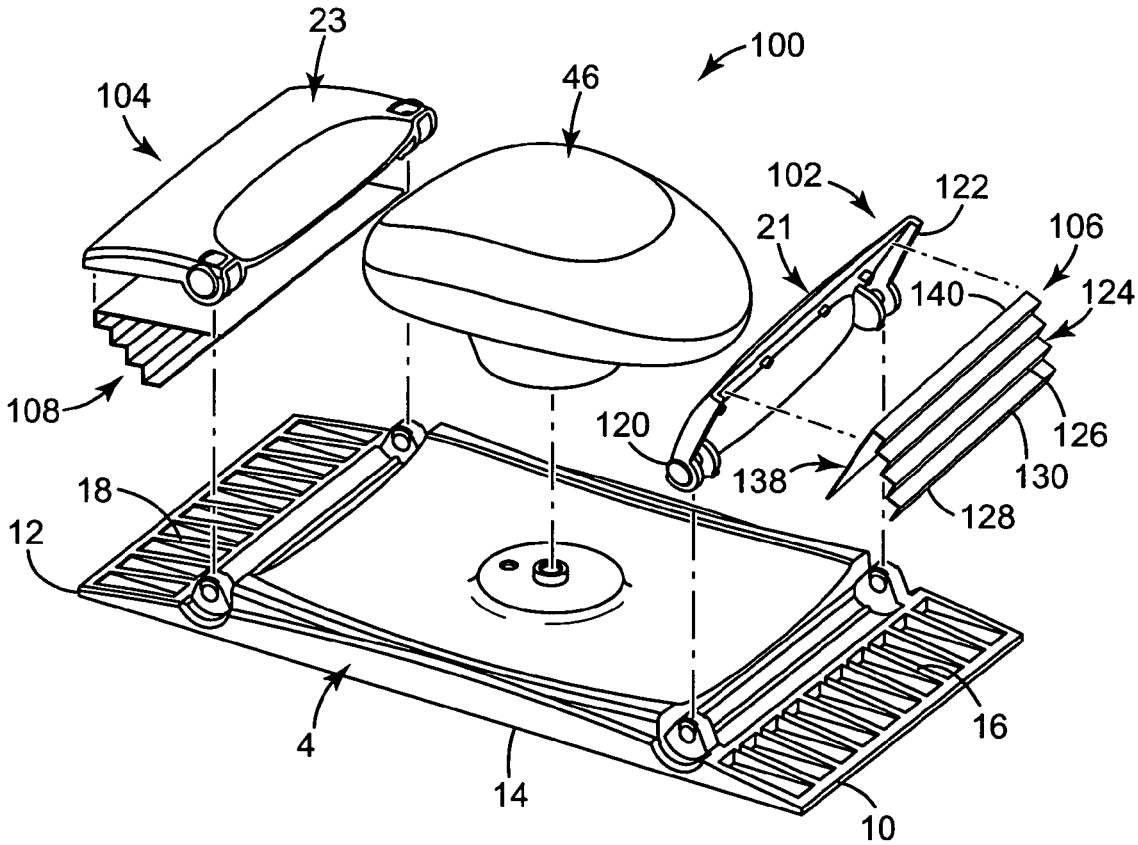
FIG. 6 is an exploded view of another embodiment hand-held, manually-operated sanding tool according to principles of the present invention.

Another embodiment hand-held, manually-operated sanding tool or sanding block 100 is shown in FIG. 6. In some embodiments, the sanding tool 100 is highly identical to the sanding tool 2 (FIGS. 1–5) previously described, with like reference numerals referring to like or corresponding parts. Thus, the sanding tool 100 is for use with a flexible, replaceable, sheet-like abrasive material 3 (FIGS. 3 and 4) as previously defined. Once again, the term "manually-operated" refers to the fact that the sanding tool 100 is not a power tool as previously described with respect to the sanding tool 2.

With the above in mind, the sanding tool 100 includes the base member 4 and a pair of clamping mechanisms 102, 104 associated with the opposed ends 10, 12, respectively, of the base member 4. In some embodiments, the sanding tool 100 further optionally includes the handle 46. Regardless, although the sanding tool 100 is shown with two of the clamping mechanisms 102, 104 configured in accordance with principles of the present invention, it will be recognized that one of the clamping mechanisms 102 or 104 may be replaced with a conventional mechanism for securing the abrasive sheet-like material 3 (FIGS. 3 and 4) to the tool 100. It will also be recognized that although the base member 4 is shown as being rectangular, it may also be square or other shapes that lend themselves for use with conventional abrasive sheets.

As previously described, the base member 4 has the first and second opposed ends 10, 12 and the generally planar bottom surface 14 against which the sheet-like abrasive material 3 (FIGS. 3 and 4) is secured. Each of the ends 10, 12 has the inclined or angled upper contact surface 16, 18, respectively, opposite the bottom surface 14.

The clamping mechanism 102 includes the pivoting member 21 (previously described) and a flexible tensioning member 106. Similarly, in some embodiments, the clamping mechanism 104 includes the pivoting member 23 (as previously described) and a flexible tensioning member 108. The clamping mechanisms 102, 104 are, in one embodiment, identical. Thus, the following discussion of the clamping mechanism 102 it is equally applicable to the clamping mechanism 104, it being understood that with other embodiments, the second clamping mechanism 104 has a different construction and can be replaced, for example, with a conventional sheet securement mechanism.

The pivoting member 21 generally defines a mounting section 120 and a front section 122. The mounting section 120 is adapted to be rotatably assembled to the base member 4 adjacent upper contact surface 16 associated with the first end 10, as previously described. The tensioning member 106 includes a gripping wall 124 forming a gripping surface 126 (referenced generally) and terminating at a leading edge 128. With this general description in mind and as described in greater detail below, in one embodiment, the gripping wall 124 forms a first lateral bend 130 adjacent the leading edge 128 that serves to position the leading edge 128 away from possible contact with the user's finger (not shown).

Figure 7A:
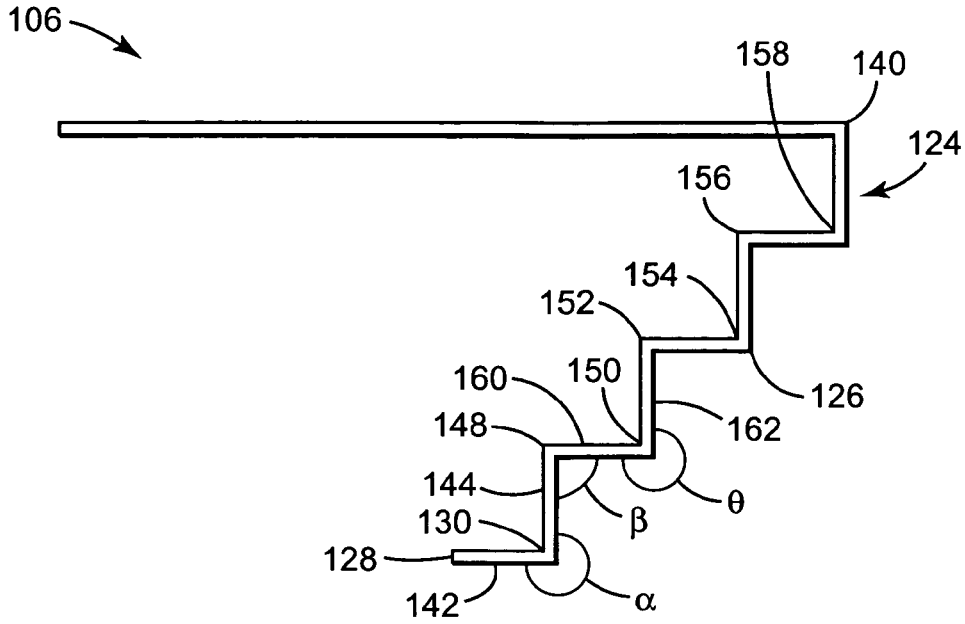
FIG. 7A is a side view of a tensioning member portion of the sanding tool of FIG. 6.

In one embodiment, the tensioning member 106 is a leaf spring-like body having a support wall 138 extending from a trailing edge 140 of the gripping wall 124 and adapted for mounting to the corresponding pivoting member 21. With this in mind, one embodiment of the tensioning member 106 is shown in enlarged form in FIGS. 7A and 7B. Once again, the gripping wall 124 defines the gripping surface 126 and forms the first bend 130 adjacent the leading edge 128 thereof. More particularly, and as best shown in FIG. 7A, the first bend 130 is formed at an intersection of first and second segments 142, 144 that combine to define the first bend 130 as having a bend angle $\alpha$. The bend angle $\alpha$ is selected such that the first segment 142 extends inwardly (relative to the trailing edge 140) from the first bend 130 to the leading edge 128. Thus, in one embodiment, the bend angle $\alpha$ is greater than 210°, more preferably in the range of 210°–300°, even more preferably in the range of 260°–280°.

To provide an enhanced interface with the sheet of abrasive material 3 (FIGS. 3 and 4), in one embodiment, the gripping wall 124 forms a plurality of bends in addition to the first bend 130. For example, the plurality of additional bends include second-seventh bends 148–158, although any other number, either lesser or greater, is also acceptable. The plurality of bends combine to form the gripping wall 124 to assume the step-like shape in side view (or transverse cross-section) reflected in FIG. 7A. For example, the second bend 148 is formed by the second segment 144 and a third segment 160 that combine to define the second bend 148 as having a bend angle β. The third bend 150 is formed by the third segment 160 and a fourth segment 162 that combine to define the third bend 150 as having a bend angle Θ. The fourth-seventh bends 152–158 are similarly formed. In one embodiment, to generate the step-like shape of FIG. 7A, the bend angle β of the second bend 148 is preferably at least 60°, more preferably in the range of 60°–120°. The bend angle Θ of the third bend 150 is at least 210°, more preferably in the range of 210°–300°, etc. Notably, while the bend angles associated with the first, third, fifth, and seventh bends 130, 150, 154, 158, respectively, are illustrated in FIG. 7A as being substantially identical, variations in the defined bend angles also acceptable. Similarly, the bend angles associated with the second, fourth, and sixth bends 148, 152, 156, respectively, need not be substantially identical as otherwise illustrated in FIG. 7A. Regardless, the first and third bends 130, 150, as well as possibly the fifth and seventh bends 154, 158, combine to define the gripping surface 126 as described in greater detail below.

Figure 7B:
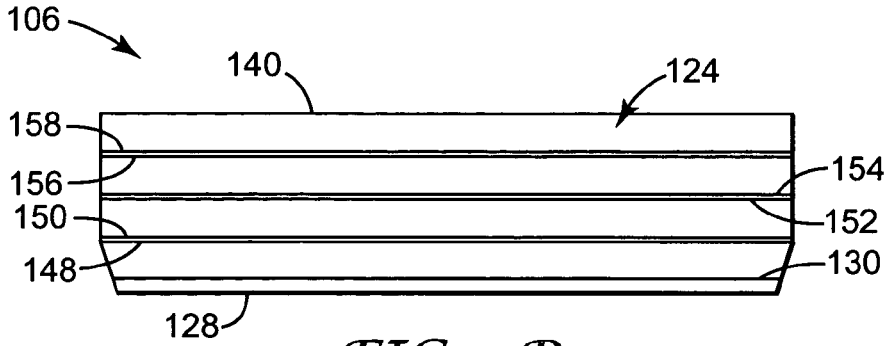
FIG. 7B is a front view of the tensioning member of FIG. 7A.

With reference to FIG. 7B, each of the bends 130, 148–158 extend laterally across an entire width of the gripping wall 124. Alternatively, at least some of the bends, and in particular, one or more of the bends 148–158, can extend less than an entire width of the gripping wall 124 and/or can be intermittent. In addition, while the bends 130, 148–158 are illustrated as being approximately equidistantly spaced relative to a length of the gripping wall 124 (i.e., extension from the trailing edge 140 to the leading edge 128), other, more random spacings are equally acceptable. Further, and in one embodiment, a width of the gripping wall 124 tapers adjacent the leading edge 128. For example, in one embodiment, a width of the first segment 142 tapers from the first bend 130 to the leading edge 128 for reducing a size of the leading edge 128 and thus inadvertent contact therewith by a user's finger (not shown). Alternatively, a width of the gripping wall 124 can be uniform or otherwise vary from that shown in FIG. 7B. Regardless, in one embodiment, at least the first bend 130 is substantially parallel with the leading edge 128.

The tensioning member 106 is, in one embodiment, formed by bending a thin sheet of metal (e.g., 304 stainless steel, 305 stainless steel, etc.). Thus, while the bends 130, 148–58 are illustrated as defining sharp corners, in other embodiments, one or more of the bends 130, 148–158 can have a curved arcuate shape.

Figure 8:
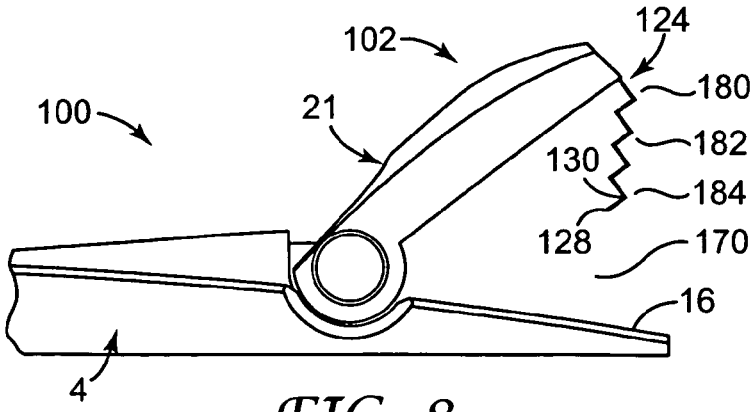
FIG. 8 is a side view of a portion of the sanding tool of FIG. 6, including a clamping mechanism in a maximum open position.

The above-described construction of the tensioning member 106, and in particular the gripping wall 124, greatly reduces the opportunity for user injury. In particular, FIG. 8 illustrates a portion of the sanding tool 100 with the clamping mechanism 102 in an open position. As previously described, the open position is achieved by rotating the pivoting member 21 relative to the base member 4 such that the front section 122 is spaced from the contact surface 16, thereby establishing a gap 170 (referenced generally) between the gripping wall 124 and the upper contact surface 16. By way of reference, a user (not shown) will commonly transition the clamping mechanism 102 to the open position when initially inserting or "loading" an end of the sheet of abrasive material 3 (FIGS. 3 and 4) into the gap 170. As part of this loading activity, the user's finger or fingers will likely enter the gap 170. With this in mind, the first bend 130 inwardly orients the leading edge 128 of the gripping wall 124, away from a direction in which the user's finger(s) will enter the gap 170. Instead, the user's finger(s), upon entering the gap 170, will first contact the first bend 130; with further movement into the gap 170, the gripping wall 124 (and thus the leading edge 128) will deflect upwardly toward the pivoting member 21 (via a force the user's finger(s) impart upon the first bend 130). Under these circumstances, the leading edge 128 will always be away from the user's finger(s). Thus, contact between the potentially sharp leading edge 128 and the user's finger(s) is avoided.

In one embodiment, to further ensure that inadvertent contact between the user's finger(s) (not shown) and the leading edge 128 (with the clamping mechanism 102 in the open position) is avoided, the pivoting member 21 and the base member 4 are configured to prevent rotation of the pivoting member 21 beyond (i.e., counterclockwise direction relative to the orientation of FIG. 8) a maximum open position. For example, and with additional reference to FIG. 5, the base member 4 can include the fixed stop projection 36 positioned to interface with the locking projection 34 as the clamping mechanism 102 (or the clamping mechanism 6 of FIG. 5) rotates from the closed position of FIG. 5. Alternatively, a fixed, maximum open position can be provided with a variety of other configurations. Regardless, a rotational position of the clamping mechanism 102 relative to the base 4 is selected in accordance with the bend angle α (FIG. 7A) of the first bend 130 so as to ensure that when a user maneuvers the clamping mechanism 102 to the maximum open position, the leading edge 128 of the gripping wall 124 is not overtly exposed relative to a likely position of the user's finger(s) when inserting the sheet of abrasive material 3 (FIGS. 3 and 4).

The gripping wall 124 configuration described above is but one acceptable embodiment, and other designs effectuating orientation of the leading edge 128 away from a likely point of contact with a user's finger(s) are within the scope of the present invention. For example, the gripping wall 124 can include or define contours or passages in the shape of holes, crosses, or sharp protrusions that otherwise project or turn the leading edge 128 in a desired direction; the leading edge 128 can have a "wavy" shape (in one or more planes); corners of the leading edge 128 (as well as other edges of the wall 124) can be rounded; etc. In more general terms, then, the gripping wall 124 can be described as defining a trailing region 180 extending from the trailing edge 140, an intermediate region 182 extending from the trailing region 180, and a leading region 184 extending from the intermediate region 182 and terminating in the leading edge 128. With these definitions in mind, the gripping wall 124 is configured such that the leading region 184 orients the leading edge 128 inwardly (relative to, for example, the gap 170), away from the intermediate region 182. This inwardly positioning of the leading edge 128 minimizes the opportunity for inadvertent user contact with the leading edge 128 as part of a loading operation.

Figure 9A:
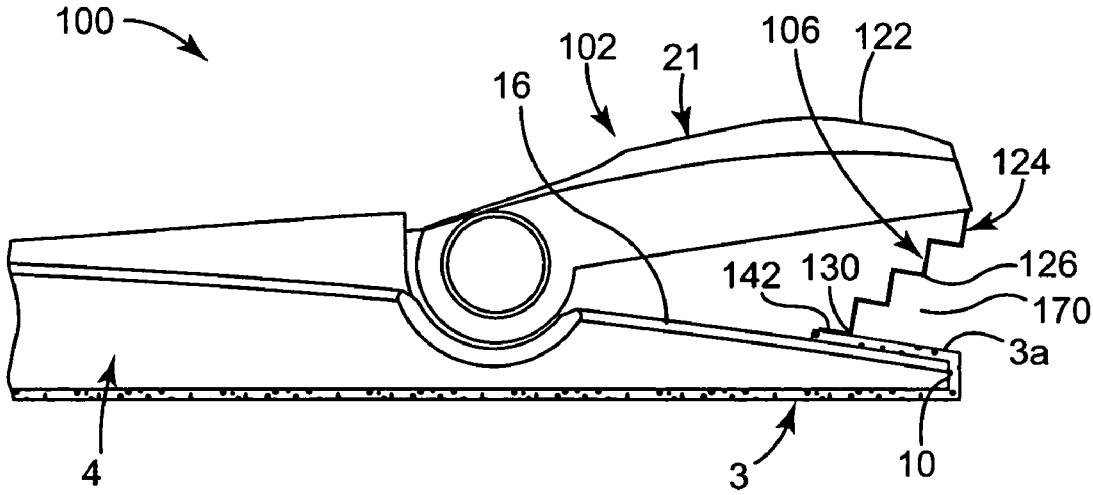
FIGS. 9A and 9B are side views of a portion of the sanding tool of FIG. 6, illustrating installation of a sheet of abrasive material to the sanding tool.

Regardless of an exact configuration of the tensioning member 106 (FIG. 6) and with reference to FIG. 9A, following insertion of the end portion 3*a* of the abrasive sheet 3 into the gap 170 (referenced generally), the clamping mechanism 102 is transitioned toward the closed position until a portion of the gripping surface 126 contacts the sheet of abrasive material 3. For example, the first bend 130 and/or the first segment 142 of the gripping wall 124 initially abuts against the sheet of abrasive material 3, thus capturing the end portion 3*a* between the gripping wall 124 and the upper contact surface 16 of the base member 4.

Figure 9B:
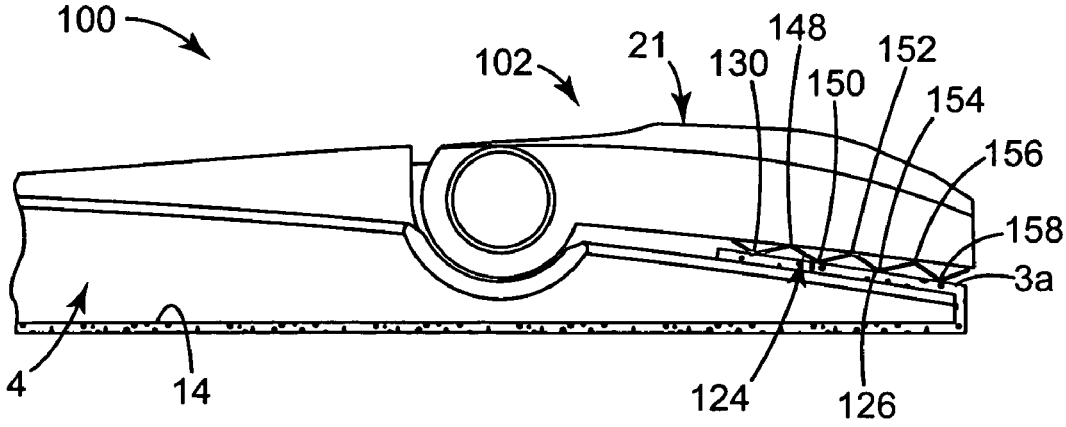

As the clamping mechanism 102 is further urged toward the contact surface 16 (i.e., the front section 122 of the pivoting member 21 is forced toward the upper contact surface 16 to achieve the closed position), the tensioning member 106 further grips the end portion 3*a* of the abrasive sheet 3 and moves it upwardly along the inclined contact surface 16 and thus away from the associated end 10. As previously described, this action draws the sheet of abrasive material 3 further into the gap 170. As shown in FIG. 9B, in the closed position, the gripping surface 126 (referenced generally) frictionally engages the end portion 3*a* at at least the first and third bends 130, 150 as the gripping wall 124 deflects in response to the external force placed upon the pivoting member 21. For example, each of the first, third, fifth, and seventh bends 130, 150, 154, and 158 intimately contact the end portion 3*a*, whereas the second, fourth, and sixth bends 148, 152, 156 are positioned opposite the end portion 3*a*. In one embodiment, a similar interface is established between the second end portion (not shown) of the abrasive sheet 3 between the clamping mechanism 104 (FIG. 6) and the upper contact surface 18 (FIG. 6) of the base member 4. In this manner, slack in the abrasive sheet 3 is taken up, thereby tightening the fit of the abrasive sheet 3 against the bottom 14 of the base member 4.

The sanding tool, and in particular the clamping mechanism, in accordance with the principles of the present invention, provides a marked improvement over previous designs. The sanding tool affords a user the ability to quickly and consistently load a sheet of abrasive material, while protecting against user injury.

Those of ordinary skill in the art may appreciate that various changes and modifications may be made to the invention described above without deviating from the inventive concept. For example, it will be recognized that the size of the tool may be adapted so it can be used with the various standard sizes of commercially available abrasive sheets. Thus, the scope of the present invention should not be limited to the structures described in this application, but only by the structures described by the language of the claims and the equivalents of those structures.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hand-held, manually-operated sanding tool for use with a replaceable sheet-like abrasive material, the sanding tool comprising:

(a) a base member defining first and second opposed ends, a bottom surface, and at least one upper contact surface opposite the bottom surface and adjacent one of the first and second ends; and (b) a clamping mechanism including:

a pivoting member having a mounting section, pivotally connected to the base member adjacent the upper contact surface, and a front section opposing the mounting section, a tensioning member including a gripping wall extending from the front section of the pivoting member and terminating in a leading edge, wherein the gripping wall forms a first bend adjacent the leading edge such that the gripping wall extends inwardly relative to the front section of the pivoting member from the first bend to the leading edge;

wherein the clamping mechanism is movable between an open position in which the pivoting member locates the gripping wall away from the upper contact surface to define a gap for receiving a sheet of abrasive material, and a closed position in which the front section of the pivoting member is more proximate the upper contact surface such that the sheet of abrasive material is tensioned between the gripping wall and the contact surface as the clamping mechanism transitions from the opened position to the closed position.

2. The sanding tool claim 1, wherein the first bend is formed across a width of the gripping wall.

3. The sanding tool claim 1, wherein the first bend is substantially parallel with the leading edge.

4. The sanding tool claim 1, wherein the first bend has a bend angle of at least 210°.

5. The sanding tool claim 1, wherein the first bend has a bend angle in the range of 210°–300°.

6. The sanding tool claim 1, wherein the gripping wall forms a plurality of spaced bends including the first bend.

7. The sanding tool claim 6, wherein the plurality of bends define the gripping wall to have a step-like shape in transverse cross-section.

8. The sanding tool claim 6, wherein the plurality of bends include a second bend adjacent the first bend opposite the leading edge and a third bend adjacent the second bend opposite the first bend, and further wherein the gripping wall is configured such that in the closed position, the first and third bends are proximate the upper contact surface and the second bend is proximate the pivoting member.

9. The sanding tool claim 8, wherein the first and third bends define bend angles in the range of 240°–300° and the second bend defines a bend angle in the range of 60°–120°.

10. The sanding tool claim 6, wherein each of the plurality of bends extend across a width of the gripping wall.

11. The sanding tool claim 1, wherein the gripping wall tapers in width from the first bend to the leading edge.

12. The sanding tool claim 1, wherein the sanding tool is configured such that, relative to an end portion of a sheet of abrasive material placed within the gap, as the clamping mechanism is transitioned from the opened position to the closed position, the first bend contacts the end section and moves the end section along the upper contact surface away from the associated end of the base member.

13. The sanding tool of claim 1, wherein the gripping wall defines a gripping surface including the first bend.

14. The sanding tool claim 1, wherein assembly of the pivoting member to the base member is adapted to limit rotation of the pivoting member relative to the base member at a maximum open position, and further wherein the clamping mechanism is configured such that in the maximum open position, the first bend is forward of the leading edge relative to the associated end of the base member.

15. The sanding tool claim 1, wherein discrete upper contact surfaces are formed adjacent each of the first and second ends, respectively, of the base member, and further wherein the sanding tool includes two of the clamping mechanisms, respective ones of which are associated with respective ones of the upper contact surfaces.

16. A hand-held, manually-operated sanding tool for use with a replaceable sheet-like abrasive material, the sanding tool comprising:

(a) a base member defining first and second opposed ends, a bottom surface, and at least one upper contact surface opposite the bottom surface and adjacent one of the first and second ends; and (b) a clamping mechanism including:

a pivoting member having a mounting section pivotally connected to the base member adjacent the upper contact surface and a front section opposite the mounting section, wherein the pivoting member can rotate relative to the base member between a closed position in which the front section is proximate the upper contact surface and an open position in which an increased spacing is established between the front section and the upper contact surface, and further wherein rotation of the pivoting member relative to the base member beyond a maximum open position is limited, a tensioning member including a gripping wall defining a trailing region extending from the front section of the pivoting member, an intermediate region extending from the trailing region, and a leading region extending from the intermediate region and terminating in a leading edge opposite the intermediate region, wherein the clamping mechanism is configured such that in the maximum open position, the leading region orients the leading edge inwardly away from the intermediate region to minimize contact between the leading edge and a user's finger inserted between the gripping wall and the upper contact surface, and further wherein the clamping mechanism serves to contact and tension a sheet of abrasive material placed between the gripping wall and the contact surface upon transitioning from the open position to the closed position.

17. The sanding tool claim 16, wherein a laterally-extending bend is defined at a transition of the intermediate segment to the leading segment.

18. The sanding tool claim 17, wherein the intermediate segment defines a plurality of complementary lateral bends.

* * * * *